US009927728B2

(12) United States Patent
Arimura et al.

(10) Patent No.: US 9,927,728 B2
(45) Date of Patent: Mar. 27, 2018

(54) METHOD FOR PRODUCING TONER PARTICLE

(71) Applicant: CANON KABUSHIKI KAISHA, Tokyo (JP)

(72) Inventors: Satoshi Arimura, Toride (JP); Yusuke Hasegawa, Suntou-gun (JP); Tomohisa Sano, Mishima (JP); Yoshitaka Suzumura, Mishima (JP); Takuma Ikejiri, Suntou-gun (JP); Shohei Yamashita, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/467,274

(22) Filed: Mar. 23, 2017

(65) Prior Publication Data

US 2017/0277051 A1 Sep. 28, 2017

(30) Foreign Application Priority Data

Mar. 24, 2016 (JP) ..... 2016-060426

(51) Int. Cl.

| | |
|---|---|
| ***G03G 9/08*** | (2006.01) |
| ***B04B 1/20*** | (2006.01) |
| ***G03G 9/087*** | (2006.01) |
| ***G03G 9/09*** | (2006.01) |

(52) U.S. Cl.

CPC ..... *G03G 9/0808* (2013.01); *B04B 1/20* (2013.01); *G03G 9/0806* (2013.01); *G03G 9/0817* (2013.01); *G03G 9/08711* (2013.01); *G03G 9/08755* (2013.01); *G03G 9/09* (2013.01); *G03G 9/0926* (2013.01)

(58) Field of Classification Search

CPC ..... G03G 9/0804; G03G 9/0815

See application file for complete search history.

(56) References Cited

U.S. PATENT DOCUMENTS

| | | | |
|---|---|---|---|
| 6,703,176 | B2 | 3/2004 | Naka et al. |
| 6,803,164 | B2 | 10/2004 | Mizoo et al. |
| 6,953,646 | B2 | 10/2005 | Doujo et al. |
| 7,123,862 | B2 | 10/2006 | Hasegawa et al. |

(Continued)

FOREIGN PATENT DOCUMENTS

| | | |
|---|---|---|
| JP | H08-137131 | 5/1996 |
| JP | 2004-258299 | 9/2004 |

(Continued)

OTHER PUBLICATIONS

U.S. Appl. No. 15/256,780, filed Sep. 6, 2016.

(Continued)

*Primary Examiner* — Peter L Vajda

(74) *Attorney, Agent, or Firm* — Fitzpatrick Cella Harper and Scinto

(57) ABSTRACT

Provided is a method for producing a toner particle including a step of condensing a raw slurry by using a decanter-type centrifugal separator, in an aqueous medium. The step of condensing the raw slurry is carried out under following conditions: a centrifugal force is at least 500 G and less than 4000 G and a temperature is at least Tg−10° C. and not more than Tg+10° C. And a ratio of a colored particles in condensed slurry is within a prescribed range.

4 Claims, 2 Drawing Sheets

(56) References Cited

U.S. PATENT DOCUMENTS

| | | | |
|---|---|---|---|
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,704,659 | B2 | 4/2010 | Ogawa et al. |
| 7,811,734 | B2 | 10/2010 | Ogawa et al. |
| 7,923,190 | B2 | 4/2011 | Magome et al. |
| 7,935,467 | B2 | 5/2011 | Dojo et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,918,035 | B2 | 12/2014 | Hasegawa et al. |
| 9,029,055 | B2 | 5/2015 | Aoki et al. |
| 9,097,997 | B2 | 8/2015 | Nomura et al. |
| 9,152,065 | B2 | 10/2015 | Sano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,377,708 | B2 | 6/2016 | Magome et al. |
| 9,423,710 | B2 | 8/2016 | Magome et al. |
| 9,454,096 | B2 | 9/2016 | Hasegawa et al. |
| 9,551,947 | B2 | 1/2017 | Hiroko et al. |
| 9,625,841 | B2 | 4/2017 | Hiroko et al. |
| 9,625,842 | B2 | 4/2017 | Uratani et al. |
| 2006/0269865 | A1* | 11/2006 | Oyama ..... G03G 9/0806 430/137.11 |
| 2008/0102395 | A1* | 5/2008 | Ohmura ..... G03G 9/08755 430/109.4 |
| 2009/0197192 | A1 | 8/2009 | Hiroko et al. |
| 2015/0227067 | A1 | 8/2015 | Hasegawa et al. |
| 2015/0227068 | A1 | 8/2015 | Sano et al. |
| 2016/0139521 | A1 | 5/2016 | Tsuda et al. |
| 2016/0154331 | A1 | 6/2016 | Tanaka et al. |
| 2016/0266509 | A1 | 9/2016 | Sano et al. |
| 2016/0378003 | A1 | 12/2016 | Arimura et al. |

FOREIGN PATENT DOCUMENTS

| | | |
|---|---|---|
| JP | 2004-258601 | 9/2004 |
| JP | 2008-225325 | 9/2008 |

OTHER PUBLICATIONS

U.S. Appl. No. 15/259,114, filed Sep. 8, 2016.
U.S. Appl. No. 15/259,293, filed Sep. 8, 2016.
U.S. Appl. No. 15/361,583, filed Nov. 28, 2016.
U.S. Appl. No. 15/362,992, filed Nov. 29, 2016.
U.S. Appl. No. 15/366,295, filed Dec. 1, 2016.
U.S. Appl. No. 15/416,055, filed Jan. 26, 2017.
U.S. Appl. No. 15/490,174, filed Apr. 18, 2017.

* cited by examiner

METHOD FOR PRODUCING TONER PARTICLE

BACKGROUND OF THE INVENTION

Field of the Invention

The present invention relates to a method for producing a toner particle used in an electrophotographic process, electrostatic recording method or magnetic recording method and the like.

Description of the Related Art

Numerous inventions have been provided that relate to toners produced by a wet toner particle production method, such as a suspension polymerization method or emulsion polymerization method using a polymerizable monomer or the like, or a dissolution suspension method in which a binder resin and the like is granulated in a solvent.

Toner produced in an aqueous medium or organic solvent as in the suspension polymerization method or emulsion polymerization method has an extremely sharp particle size distribution. Consequently, in addition to being able to realize high developing performance and high transferability, high yield can also be achieved, thereby making the toner superior from the viewpoint of productivity.

Toner produced using a wet method is obtained by forming a toner particle in an aqueous medium or organic solvent to obtain a toner particle-dispersed solution, followed by separating the toner particle from the toner particle-dispersed solution using a separation means, typically represented by solid-liquid separation device in the manner of a filtration device, and subsequently adding an external additive as necessary.

In recent years, photocopiers and printers using an electrophotographic method have come to be required to offer faster speed, higher image quality and reduced size, and high-definition images are required to be provided despite increasing device process speeds. Since the load on the toner increases as process speed becomes faster, there is increased the occurrence of problems relating to developing performance such as fogging of non-image areas due to toner deterioration particularly in environments at low temperature and low humidity. In addition, from the viewpoint of high-definition images, a developing system in which the toner carrying member and electrostatic latent image bearing member are arranged in contact (to be subsequently referred to as a "contact development system") is preferable. However, contact development systems place a greater load on the toner since the toner is subjected to pressure between the toner carrying member and the electrostatic latent image bearing member. It is even more important to enhance toner toughness under such circumstances.

However, from the viewpoint of productivity, it is also necessary to shorten the amount of time consumed by each process during the course of toner production. Toner produced using a wet method is produced under various temperature conditions in a series of steps involving a material dispersion step, colored particle formation step, polymerization step, filtration step and drying step. Among these, productivity can be improved considerably by shortening the amount of time consumed during the process of returning the toner from a high temperature as in the polymerization step or drying step in particular to a normal temperature in a subsequent step.

However, sudden changes in temperature cause the occurrence of differences in the degree to which materials adhere to the binder resin in the toner particle due to, for example, differences in the coefficient of thermal expansion between materials used therein. This tendency is particularly prominent in the case of toner containing magnetic powder as colorant since the coefficient of thermal expansion of the magnetic powder differs greatly from that of other materials. Cracking, chipping and other problems tend to occur resulting in inferior durability in the case toner is subjected to stress over a long period of time as a result of a decrease in adhesiveness.

Numerous inventions have been provided that improve toner performance by removing impurities using a separation device simultaneous to separate colored particles from an aqueous medium during production using a wet method. For example, Japanese Patent Application Laid-open No. 2004-258601 proposes a method for removing impurities present in toner slurry by using a filter having two or more types of meshes during solid-liquid separation. In addition, Japanese Patent Application Laid-open No. H8-137131 similarly proposes a method for removing impurities in toner slurry by using a screw decanter type of continuous centrifugal settler.

SUMMARY OF THE INVENTION

However, the above-mentioned Japanese Patent Application Laid-open Nos. 2004-258601 and H8-137131 do not adequately discuss the adhesiveness of materials to binder resin in a toner particle, thereby leaving room for improvement in the separation step.

A purpose of the present invention is to provide a toner capable of solving the above-mentioned problems.

More specifically, a toner is provided that allows the obtaining of favorable image density and allows the obtaining of favorable stable images free of the occurrence of fogging or development streaks even under conditions of long-term durable use in an environment at low temperature and low humidity using a compact image forming apparatus.

The inventors of the present invention found that the above-mentioned problems can be solved by providing a device that separates colored particles from aqueous medium and defining the temperature and pressure applied at that time, thereby leading to completion of the present invention. Namely, the present invention is as indicated as follows. A method for producing a toner particle comprising a treatment step of treating a raw slurry containing an aqueous medium and colored particles each containing a binder resin and a colorant, wherein the treatment step includes a step of condensing the raw slurry by using a decanter-type centrifugal separator so as to obtain a condensed slurry, the decanter-type centrifugal separator includes an external rotary cylinder and a screw conveyor provided within the external rotary cylinder so as to be able to rotate relatively with the external rotary cylinder, and the step of condensing the raw slurry is carried out under conditions below:

i) a centrifugal force is at least 500 G and less than 4000 G; and ii) a temperature (Ts) is at least Tg−10° C. and not more than Tg+10° C. when the glass transition temperature of the colored particles is defined as Tg (° C.), and wherein when a ratio of the colored particles in the condensed slurry is defined as ratio B, the ratio B is at least 10% by mass and not more than 60% by mass.

Further features of the present invention will become apparent from the following description of exemplary embodiments with reference to the attached drawings.

DESCRIPTION OF THE EMBODIMENTS

Figure 1:
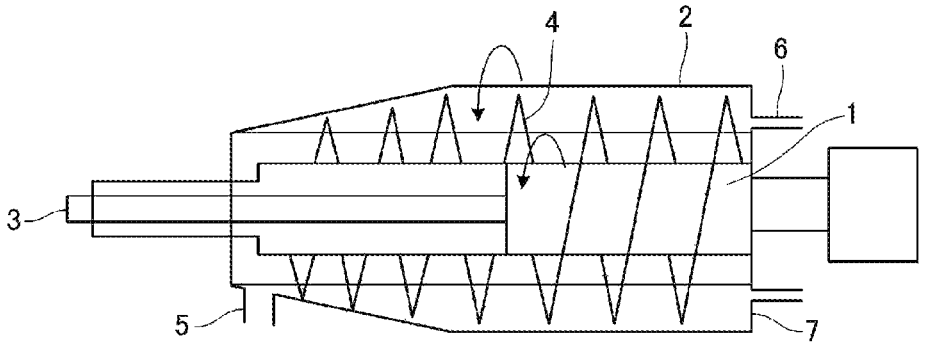
FIG. 1 is a drawing showing one example of a decanter-type centrifugal separator.

In the present invention, descriptions of "at least XX and not more than YY" or "XX to YY" refer to a numerical range that includes the end points of the lower limit and upper limit unless specifically indicated otherwise.

The following provides a detailed explanation of the invention.

The present invention is a method for producing a toner particle comprising a treatment step of treating a raw slurry containing an aqueous medium and colored particles each containing a binder resin and a colorant, wherein the treatment step includes a step of condensing the raw slurry by using a decanter-type centrifugal separator so as to obtain a condensed slurry, the decanter-type centrifugal separator includes an external rotary cylinder and a screw conveyor provided within the external rotary cylinder so as to be able to rotate relatively with the external rotary cylinder, and the step of condensing the raw slurry is carried out under conditions below:

i) a centrifugal force is at least 500 G and less than 4000 G; and ii) a temperature (Ts) is at least Tg−10° C. and not more than Tg+10° C. when the glass transition temperature of the colored particles is defined as Tg (° C.), and wherein when a ratio of the colored particles in the condensed slurry is defined as ratio B, the ratio B is at least 10% by mass and not more than 60% by mass.

The present invention is characterized by treating a slurry by using a decanter-type centrifugal separator in a specific temperature state within a specific range of centrifugal force. And the decanter-type centrifugal separator includes an external rotary cylinder and a screw conveyor provided within the external rotary cylinder.

Toner produced in an aqueous medium or organic solvent in the manner of a suspension polymerization method or emulsion polymerization method is produced under various temperature conditions in a series of steps such as a material dispersion step, colored particle formation step or polymerization step. When the temperature is changed in each step, differences occur in adhesiveness between each of the toner raw materials and the binder resin within the colored particles due to differences in such parameters as coefficient of thermal expansion or thermal responsiveness between each of the toner raw materials. In the case of toner containing magnetic powder as colorant in particular, differences in adhesiveness are prominent since the magnetic powder exhibits a different coefficient of thermal expansion or thermal responsiveness from each of the materials used in the toner.

In addition, although it is preferable to shorten the amount of time consumed to cool high-temperature slurry or toner to normal temperature from the viewpoint of productivity, differences in thermal responsiveness among the raw materials become increasingly prominent, thereby resulting in a decrease in adhesiveness. In addition, differences in adhesiveness become more prominent in the case of having a step involving rapidly cooling from a high temperature in view of improving toner performance.

The presence of differences in adhesiveness among toner particles results in impaired ductility with respect to impacts and embrittlement of the toner particles.

In order to solve the above-mentioned problems, it is important to condense a raw slurry containing the colored particles and aqueous medium at a centrifugal force of at least 500 G and less than 4000 G and at a temperature Ts (° C.) within a range below:

$$Tg-10^\circ\ \text{C.} \leq Ts \leq Tg+10^\circ\ \text{C.}$$

based on the glass transition temperature Tg (° C.) of the colored particles. The range below is more preferable:

$$Tg-5^\circ\ \text{C.} \leq Ts \leq Tg+5^\circ\ \text{C.}$$

Furthermore, the temperature Ts is measured as a temperature of a slurry inside the treatment device.

As a result of being within the above-mentioned temperature range, the binder resin in the colored particles is predicted to be in a somewhat softened state. Due to this softening of the binder resin, raw materials containing binder resin present within the colored particles are able to move more freely to a certain degree. However, simply being within the above-mentioned temperature range only allows the raw materials to move, and order for the raw materials to actually move, a physical external force and treatment in the manner of so-called annealing to maintain that temperature state are required.

In the present invention, it was noticed that raw materials containing binder resin are able to be moved by allowing centrifugal force to act thereon while maintaining that temperature state. The reason why the inventors of the present invention focused on centrifugal force is as follows. In a decanter-type centrifugal separator, the colored particles are subjected to centrifugal force after being injected into the device and are discharged while rolling. As a result of rolling within the device while being subjected to centrifugal force, the colored particles are able to be subjected to force uniformly from all directions, thereby making it possible to uniformly improve adhesiveness within the colored particles.

In the case the temperature Ts is less than the temperature that is 10° C. lower than the Tg of the colored particles, softening of the binder resin becomes inadequate, raw materials are unable to move freely within the colored particles, and the effects of the present invention are unable to be obtained. In addition, in the case the temperature Ts exceeds the temperature that is 10° C. higher than the Tg of the colored particles, softening of the colored particles is accelerated, and when an external force in the manner of centrifugal force is applied, coalescence of the colored particles is also accelerated. As coalescence of the colored particles progresses, cracking and chipping occur at the coalesced surfaces or flowability decreases as a result of the toner not being spherical, thereby resulting in a decrease in toner performance.

In addition, in the case the centrifugal force is less than 500 G, external force applied to the colored particles is inadequate, which in turn causes adhesiveness to be inadequate and prevents the effects of the present invention from being obtained. If centrifugal force is at least 4000 G, coalescence of colored particles is accelerated due to the strong external force, which again results in a similar decrease in toner performance. Furthermore, this centrifugal force indicates the highest centrifugal force within the treatment device.

This centrifugal force is preferably at least 2000 G and less than 4000 G.

The decanter-type centrifugal separator has a structure that makes it easy for colored particles to roll along the walls of the external rotary cylinder, and is more preferable since it allows adhesiveness within the color particles to be uniformly improved.

In addition, when a ratio of the colored particles in the condensed slurry is defined as ratio B, the ratio B needs to be at least 10% by mass and not more than 60% by mass. Further, when a ratio of the colored particles of the raw slurry is defined as ratio A, the ratio A is preferably at least 5% by mass and not more than 40% by mass. The ratios are the proportion of the mass of the colored particles based on the total mass of the colored particles and aqueous medium.

More preferably, A is such that 5% by mass≤A≤20% by mass and B is such that B≤50% by mass. Even more preferably, B is such that B≤40% by mass. B is preferably at least 10% by mass and more preferably at least 15% by mass.

The ratio A being within the above-mentioned range indicates a comparatively low solid concentration. As a result of making the raw slurry rich in aqueous medium prior to being loaded into the device, colored particles are able to roll more actively within the device, thereby improving adhesiveness. Moreover, slurry concentration B after separation being not more than 60% by mass means that the discharged colored particles are in the state of a slurry having a comparatively high content of aqueous medium. As a result of aqueous medium being present around the colored particles from the time they are charged into the device until the time they are discharged therefrom, the colored particles are able to roll for a long period of time within the device, thereby making this preferable.

If the ratio A is at least 5% by mass, aqueous medium is suitably present around the colored particles, and the colored particles are able to adequately reach the external rotary cylinder when the colored particles and aqueous medium are separated within the device by centrifugal force. In addition, if the ratio A is not more than 40% by mass, aqueous medium is adequately present around the colored particles and the colored particles are able to easily roll within the device. In addition, if the ratio B is not more than 60% by mass, there is no excessive decrease in aqueous medium around the colored particles by the time they are discharged, and rolling of the colored particles is particularly favorable in the vicinity of the discharge outlet. When the ratio B is at least 10% by mass, a processing efficiency in the following steps such as washing step is improved.

The following provides an explanation of a preferable aspect of the toner of the present invention.

The present invention preferably uses a crystalline material. A known material such as wax or crystalline polyester can be used for the crystalline material, and one type or two or more types of crystalline materials may be used as necessary. In addition, the colored particles preferably contain ester wax or crystalline polyester for the crystalline material since it is highly compatible with the binder resin. The use of a material that is highly compatible with the binder resin results in promotion of softening when the binder resin approaches the glass transition temperature, thereby making it easier to obtain the effects of the present invention.

Furthermore, crystallinity refers to the presence of a sharp endothermic peak in differential scanning calorimetry (DSC).

Examples of wax include aliphatic hydrocarbon-based waxes such as low molecular weight polyethylene, low molecular weight polypropylene, microcrystalline wax, Fischer-Tropsch wax or paraffin wax, oxides of aliphatic hydrocarbon-based waxes or block copolymers thereof such as polyethylene oxide wax, waxes composed mainly of aliphatic esters such as carnauba wax or montanic acid ester wax along with waxes obtained by deoxidizing all or a portion of a fatty acid ester such as deoxidized carnauba wax, saturated linear fatty acids such as palmitic acid, stearic acid or montanic acid, unsaturated fatty acids such as brassidic acid, eleostearic acid or parinaric acid, saturated alcohols such as stearyl alcohol, aralkyl alcohol, behenyl alcohol, carnaubyl alcohol, ceryl alcohol or melissyl alcohol, polyvalent alcohols such as sorbitol, aliphatic amides such as linoleic acid amide, oleic acid amide or lauric acid amide, saturated fatty acid bisamides such as methylene bis(stearamide), ethylene bis(capramide), ethylene bis(lauramide) or hexamethylene bis(stearamide), unsaturated fatty acid amides such as ethylene bis(oleamide), hexamethylene bis(oleamide), N,N'-dioleyladipamide or N,N'-dioleylsebacamide, aromatic bisamides such as m-xylene bis(stearamide) or N,N'-distearylisophthalamide, aliphatic metal salts (commonly referred to as metal soaps) such as calcium stearate, calcium laurate, zinc stearate or magnesium stearate, waxes obtained by grafting a vinyl-based monomer such as styrene or acrylic acid to an aliphatic hydrocarbon-based wax, partially esterified product of fatty acid and polyvalent alcohol such as behenic monoglyceride, and methyl ester compounds having a hydroxyl group obtained by hydrogenation of a vegetable oil.

In the case of using a wax in the present invention, the wax is preferably an ester wax as described above. An ester wax refers to a crystalline wax having an ester bond. The number of ester bonds is preferably 1 to 6.

Examples of monofunctional ester waxes that can be used include condensates of an aliphatic alcohol having 6 to 12 carbon atoms and a long-chain carboxylic acid, and condensates of an aliphatic carboxylic acid having 4 to 10 carbon atoms and a long-chain alcohol. Furthermore, the prefix used before the term "x-functional ester wax" indicates condensates of an x-valent alcohol and a monocarboxylic acid, or condensates of an x-valent carboxylic acid and a monoalcohol.

Examples of aliphatic alcohols include 1-hexanol, 1-heptanol, 1-octanol, 1-nonanol, 1-decanol, undecyl alcohol and lauryl alcohol. In addition, examples of aliphatic carboxylic acids include pentanoic acid, hexanoic acid, heptanoic acid, octanoic acid, nonanoic acid and decanoic acid.

Examples of bifunctional ester waxes that can be used include condensates of a dicarboxylic acid and a monoalcohol and condensates of a diol and a monocarboxylic acid.

Examples of dicarboxylic acids include adipic acid, pimelic acid, suberic acid, azelaic acid, decanedioic acid and dodecanedioic acid.

Examples of diols include 1,6-hexanediol, 1,7-heptanediol, 1,8-octanediol, 1,9-nonanediol, 1,10-decanediol, 1,11-undecanediol and 1,12-dodecanediol. Furthermore, although linear fatty acids and linear alcohols are exemplified here, these may also have a branched structure. Among these, 1,6-hexanediol, 1,9-nonanediol, 1,10-decanediol and 1,12-dodecanediol are preferable, and 1,9-nonanediol and 1,10-decanediol are particularly preferable since they facilitate demonstration of the effects of the present invention.

An aliphatic alcohol is preferable for the monoalcohol condensed with dicarboxylic acid. Specific examples thereof include tetradecanol, pentadecanol, hexadecanol, heptadecanol, octadecanol, nonadecanol, eicosanol, docosanol, tricosanol, tetracosanol, pentacosanol, hexacosanol and octacosanol. Among these, docosanol is preferable from the viewpoints of fixability and developing performance.

The monocarboxylic acid that condenses with a diol is preferably an aliphatic carboxylic acid. Specific examples of fatty acids include lauric acid, myristic acid, palmitic acid, margaric acid, stearic acid, tuberculostearic acid, arachidic acid, behenic acid, lignoceric acid and cerotic acid. Among these, behenic acid is preferable from the viewpoints of fixability and developing performance.

Examples of trifunctional ester waxes include condensates of a glycerin compound and a monofunctional aliphatic carboxylic acid. Examples of tetrafunctional ester waxes include condensates of pentaerythritol and a monofunctional aliphatic carboxylic acid and condensates of diglycerin and carboxylic acid. Examples of pentafunctional ester waxes include condensates of triglycerin and a monofunctional aliphatic carboxylic acid. Examples of hexafunctional ester waxes include condensates of dipentaerythritol and a monofunctional aliphatic carboxylic acid and condensates of tetraglycerin and a monofunctional aliphatic carboxylic acid.

The wax content is preferably at least 1 part by mass and not more than 30 parts by mass based on 100 parts by mass of binder resin.

Next, a description is provided of crystalline polyester.

Although a known crystalline polyester can be used in the present invention, the crystalline polyester is preferably a polyester formed by a linear aliphatic dicarboxylic acid represented by the following formula (1) and a linear aliphatic diol represented by the following formula (2):

$$HOOC—(CH_2)_m—COOH \quad (1)$$

(wherein, m represents an integer of 4 to 14), and $$HO—(CH_2)_n—OH \quad (2)$$

(wherein, n represents an integer of 4 to 16).

A linear polyester formed by a carboxylic acid represented by the above-mentioned formula (1) and a diol represented by the above-mentioned formula (2) has superior crystallinity and easily forms a domain. In addition, if the values of m in formula (1) and n in formula (4) are at least 4, the resulting toner has superior low-temperature fixability since the melting point (Tm) has a favorable range for toner fixation. In addition, values of m in formula (1) of not more than 14 and n in formula (2) of not more than 16 facilitate acquisition of practical materials.

Furthermore, monovalent acids such as acetic acid or benzoic acid or monovalent alcohols such as cyclohexanol or benzyl alcohol are used as necessary for the purpose of adjusting acid value or hydroxyl value and the like.

The content of crystalline polyester is preferably at least 0.5 parts by mass and not more than 20.0 parts by mass based on 100 parts by mass of binder resin.

Crystalline polyester can be produced by an ordinary polyester synthesis method. For example, crystalline polyester can be obtained by subjecting a dicarboxylic acid component and a diol component to an esterification reaction or transesterification reaction followed by reducing pressure or introducing nitrogen gas and carrying out a polycondensation reaction in accordance with ordinary methods.

An ordinary esterification catalyst or transesterification catalyst such as sulfuric acid, tertiary-butyl titanium butoxide, dibutyltin oxide, manganese acetate or magnesium acetate can be used as necessary during esterification or transesterification. In addition, with respect to polymerization, an ordinary known polymerization catalyst such as tertiary-butyl titanium butoxide, dibutyltin oxide, tin acetate, zinc acetate, tin disulfide, antimony trioxide or germanium dioxide can be used. There are no particular limitations on the polymerization temperature or amount of catalyst, and may be selected arbitrarily as necessary.

A titanium catalyst is preferable for the above-mentioned catalyst, and a chelated titanium catalyst is more preferable. This is because of the suitable level of reactivity of titanium catalysts, thereby allowing the obtaining of a polyester having a desirable molecular weight distribution for the present invention.

In addition, the acid value of the crystalline polyester can be controlled by blocking the carboxyl group on the polymer terminal. A monocarboxylic acid or monoalcohol can be used for terminal blocking. Examples of monocarboxylic acids include benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid and stearic acid. Examples of monoalcohols include methanol, ethanol, propanol, isopropanol, butanol and higher alcohols.

Examples of binder resins that can be used include styrene and homopolymers of substituted forms thereof such as polystyrene or polyvinyl toluene, as well as styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymer, styrene-isoprene copolymers, styrene-maleic acid copolymers. These can be used alone or two or more types can be used in combination. In the present invention, the glass transition temperature Tg of the binder resin is preferably at least 47° C. and not more than 65° C. In the case the glass transition temperature Tg is within this range, crystalline materials are facilitated to crystallize adequately, thereby making this preferable.

Examples of colorant used in the present invention include the following organic pigments, organic dyes and inorganic pigments.

Examples of cyan colorants include copper phthalocyanine compounds and derivatives thereof, anthraquinone compounds and basic dye lake compounds. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62 and C.I. Pigment Blue 66. Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221 and C.I. Pigment Red 254.

Examples of yellow colorants include condensed azo compounds, isoindolinone compounds, anthraquinone compounds, azo metal complexes, methine compounds and arylamide compounds. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 185, C.I. Pigment Yellow 191 and C.I. Pigment Yellow 194.

Examples of black colorants include carbon black and colorants tinted black using the above-mentioned yellow colorants, magenta colorants, cyan colorants and magnetic powder.

These colorants can be used alone or mixed or in the state of a solid solution. The colorant used in the present invention is selected from the viewpoints of hue angle, chroma, lightness, lightfastness, OHP transparency and dispersibility in a toner particle.

The content of colorants other than magnetic powder is preferably at least 1 part by mass and not more than 20 parts by mass based on 100 parts by mass of the binder resin or polymerizable monomer that composes the binder resin. Content in the case of using a magnetic powder is preferably at least 20 parts by mass and not more than 200 parts by mass, and more preferably at least 40 parts by mass and not more than 150 parts by mass, based on 100 parts by mass of the binder resin or polymerizable monomer that composes the binder resin.

The colorant preferably contains magnetic powder. The magnetic powder is preferably that having magnetic iron oxide such as triiron tetraoxide or γ-iron oxide as a main component thereof. In addition, it may also contain elements such as phosphorous, cobalt, nickel, copper, magnesium, manganese, aluminum or silicon. These magnetic powders preferably have a BET specific surface as determined according to the nitrogen adsorption method of at least 2 $m^2/g$ and not more than 30 $m^2/g$ and more preferably at least 3 $m^2/g$ and not more than 28 $m^2/g$. In addition, Mohs hardness is preferably 5 to 7. Although examples of the shape of the magnetic powder include that in the form of a polyhedron, octahedron, hexahedron, sphere, needle or flake, a shape having little anisotropy in the manner of a polyhedron, octahedron, hexahedron or sphere is preferable in terms of enhancing image density.

The number-average particle diameter of the magnetic powder is preferably 0.10 μm to 0.40 μm. In general, a smaller magnetic powder particle diameter results in greater tinting strength. If the number-average particle diameter is within the above-mentioned range, the magnetic powder is resistant to aggregation, and uniform dispersibility of the magnetic powder in toner is favorable. In addition, if the number-average particle diameter is at least 0.10 μm, the magnetic powder per se is resistant to taking on a red-tinted black color and the red tint is less likely to be conspicuous in halftone images in particular, thereby allowing the obtaining of high image quality. On the other hand, if the number-average particle diameter is not more than 0.40 μm, tinting strength of the toner becomes favorable and the magnetic powder can be uniformly dispersed during suspension polymerization (to be subsequently described).

Furthermore, the number-average particle diameter of the magnetic powder can be measured using a transmission electron microscope. More specifically, after having adequately dispersed the toner particle to be observed in epoxy resin, the resin is cured for 2 days in an atmosphere at a temperature of 40° C. to obtain the resulting cured product. The resulting cured product is then sliced into thin sections with a microtome for use as samples followed by measuring the diameters of 100 particles of the magnetic powder in a single field of a micrograph at a magnification factor of 10,000× to 40,000× with a transmission electron microscope (TEM). The number-average particle diameter is then calculated based on the equivalent diameter of a circle equal to the projected area of the magnetic powder. In addition, particle diameter can also be measured with an image analyzer.

The magnetic powder can be produced according to, for example, the method described below. Namely, an amount of a base such as sodium hydroxide equivalent to or greater than the amount of the iron component is added to an aqueous solution of a ferrous salt to prepare an aqueous solution containing ferrous hydroxide. Air is then blown in while maintaining the pH of the prepared aqueous solution at 7 or higher and the ferrous hydroxide is subjected to an oxidation reaction while warming the aqueous solution to at least 70° C. to first form seed crystals serving as the cores of the magnetic iron oxide powder.

Next, an aqueous solution containing about one equivalent of ferrous sulfate based on the previously added amount of base is added to the slurry-like liquid containing seed crystal. Reaction of the ferrous hydroxide is allowed to proceed while blowing in air and maintaining the pH of the liquid at 5 to 10 to allow the magnetic iron oxide powder to grow using the seed crystals as the cores thereof. At this time, the shape and magnetic properties of the magnetic powder can be controlled by arbitrarily selecting pH, reaction temperature and stirring conditions. Although the pH of the liquid shifts to the acidic side as the oxidation reaction proceeds, the pH of the liquid is preferably not allowed to go below 5. A magnetic powder can then be obtained by filtering, washing and drying the resulting magnetic powder in accordance with established methods.

In addition, in the case of producing the toner particle in an aqueous medium, it is extremely preferable to subject the surface of the magnetic powder to hydrophobic treatment. In the case of treating the surface using a dry method, the magnetic powder is treated with a coupling agent following washing, filtering and drying. In the case of treating the surface using a wet method, the magnetic powder is re-dispersed after being dried following completion of the oxidation reaction, or re-dispersed in a different aqueous medium without drying the iron oxide form obtained by washing and filtering following completion of the oxidation reaction, followed by subjecting to coupling treatment. In the present invention, a wet method or dry method can be suitably selected.

Examples of coupling agents able to be used for surface treatment of magnetic powder in the present invention include silane coupling agents and titanium coupling agents. Silane coupling agents are used more preferably and are represented by the following general formula (I):

$$R_mSiY_n \quad (I)$$

(wherein, R represents an alkoxy group having 1 to 10 carbon atoms, m represents an integer of 1 to 3, Y represents a functional group such as an alkyl group, phenyl group, vinyl group, epoxy group, acrylic group or methacrylic group, and n represents an integer of 1 to 3 provided that m+n=4).

Examples of silane coupling agents represented by general formula (I) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane. In the present invention, a silane coupling agent in which Y in general formula (I) represents an alkyl group can be used preferably. Among these, an alkyl group having at least 3 and not more than 6 carbon atoms is preferable, while that having 3 or 4 carbon atoms is more preferable.

In the case of using a silane coupling agent as indicated above, the surface of the magnetic powder can be treated using one type of silane coupling agent or by combining the use of a plurality of types thereof. In the case of combining the use of a plurality of silane coupling agents, the surface of the magnetic powder may be treated with each coupling agent separately or simultaneously.

The total amount of coupling agent used to treat the surface of the magnetic powder is preferably at least 0.9 parts by mass and not more than 3.0 parts by mass based on 100 parts by mass of the magnetic powder, and the amount of treatment agent is preferably adjusted corresponding to such factors as the surface area of the magnetic powder or the reactivity of the coupling agent.

In the present invention, other colorant may also be used in addition to the magnetic powder. Examples of colorants that can be used in combination therewith include the above-mentioned known dyes and pigments as well as magnetic and non-magnetic inorganic compounds. Specific examples thereof include ferromagnetic metal particles such as cobalt or nickel particles and alloys obtained by adding chromium, manganese, copper, zinc, aluminum or rare earth metals thereto, particles such as hematite, titanium black, nigrosine dyes and pigments, carbon black and phthalocyanine. These may also be preferably used after treating the surfaces thereof.

Furthermore, the content of magnetic powder in the toner can be measured using the TGA7 Thermogravimetric Analyzer manufactured by PerkinElmer Inc. The measurement method is as follows. Namely, toner is heated from normal temperature to 900° C. at a ramp rate of 25° C./minute in a nitrogen atmosphere. The mass loss percentage from 100° C. to 750° C. is taken to be the amount of binder resin and the residual mass is taken to approximately be the amount of magnetic powder.

In the present invention, a charge control agent may be used to stably maintain the charging performance of the toner regardless of the environment. Examples of negatively charged charge control agents include monoazo metal compounds, acetyl acetone metal compounds, metal compounds with aromatic oxycarboxylic acids, aromatic dicarboxylic acids, oxycarboxylic acids and dicarboxylic acids, aromatic oxycarboxylic acids, aromatic mono- and polycarboxylic acids and metal salts thereof, anhydrides, esters, phenol derivatives such as bisphenol, urea derivatives, metal-containing salicylic acid-based compounds, metal-containing naphthoic acid-based compounds, boron compounds, quaternary ammonium salts, calixarene and resin-based charge control agents.

Examples of positively charged charge control agents include nigrosine and nigrosine modification products such as those modified by fatty acid metal salts, guanidine compounds, imidazole compound, quaternary ammonium salts such as tributylbenzylammonium 1-hydroxy-4-naphthosulfonate or tetrabutylammonium tetrafluoroborate and analogues thereof in the form of onium salts such as phosphonium salts along with lake pigments thereof, triphenylmethane dyes and lake pigments thereof (obtained using laking agents such as phosphotungstic acid, phosphomolybdic acid, phosphotungstomolybdic acid, tannic acid, lauric acid, gallic acid, ferricyanide or ferrocyanide), metal salts of higher fatty acids, diorganotin oxides such as dibutyltin oxide, dioctyltin oxide or dicyclohexyltin oxide, diorganotin borates such as dibutyltin borate, dioctyltin borate or dicyclohexyltin borate, and resin-based charge control agents.

These can be used alone or two or more types can be used in combination.

Among these, the charge control agent other than a resin-based charge control agent is preferably a metal-containing salicylic acid-based compound, and particularly preferably that in which the metal thereof is aluminum or zirconium. A particularly preferable control agent is an aluminum salicylate compound.

Polymers or copolymers having a sulfonic acid group, sulfonate group, sulfonic acid ester group, salicylic acid site or benzoic acid site are preferably used as resin-based charge control agents. The incorporated amount of the charge control agent is preferably 0.01 parts by mass to 20.0 parts by mass, and more preferably 0.05 parts by mass to 10.0 parts by mass, based on 100.0 parts by mass of the polymerizable monomer that composes the binder resin.

The weight-average particle diameter (D4) of the toner particle is preferably at least 3.0 μm and not more than 12.0 μm, and more preferably at least 4.0 μm and not more than 10.0 μm. If the weight-average particle diameter (D4) is at least 3.0 μm and not more than 12.0 μm, favorable flowability is obtained and images can be developed that faithfully represent the latent image.

With the exception of a specific treatment step, the toner particle can be produced by any known method.

First, in the case of producing by a pulverization method, for example, binder resin, colorant and optionally crystalline material, charge control agent and other additives are adequately mixed with a mixer such as a Henschel mixer or ball mill. Subsequently, the toner materials are dispersed or dissolved by melting and kneading using a heat kneading machine in the manner of a heating roller, kneader or extruder, and then solidified by cooling and pulverized followed by classifying and subjecting to surface treatment as necessary to obtain colored particles. The classification and surface treatment may be carried out in any order. A multi-grade classifier is used preferably in the classification step in terms of production efficiency.

In the case of producing colored particles by a dry method in the manner of a pulverization method, the colored particles are preferably charged into an aqueous medium having a dispersing agent dispersed therein to obtain a slurry (dispersed solution), followed by carrying out a specific treatment step that uses a device having a structure that separates the slurry into the aqueous medium and the colored particles.

In the present invention, a step is preferably contained for obtaining colored particles by suspension polymerization or emulsion polymerization. Suspension polymerization or emulsion polymerization is easily incorporated in the production process since colored particles are produced in an aqueous medium. In addition to allowing the obtaining of toner having a sharp particle size distribution and high circularity, these production methods facilitate the formation of toner having a core-shell structure. Consequently, the effects of the present invention can be further enhanced.

Examples of aqueous media include water and mixed solvents of water and alcohol such as methanol, ethanol or propanol.

The following provides a description of suspension polymerization.

Suspension polymerization allows the obtaining of a polymerizable monomer composition by uniformly dissolving or dispersing a polymerizable monomer composing the binder resin and a colorant (and additionally a crystalline material, polymerization initiator, crosslinking agent, charge control agent and other additives as necessary). Subsequently, the polymerizable monomer composition is dispersed and granulated in a continuous layer containing a dispersing agent (for example, an aqueous phase) using a suitable stirrer. The polymerizable monomer contained in the polymerizable monomer composition is then subjected to a polymerization reaction to obtain colored particles having a desired particle diameter. Toner obtained using this suspension polymerization method (to also be referred to as "polymerized toner") can be expected to improve image quality since the distribution of charge quantity is also comparatively uniform due to the individual toner particles having a nearly uniform spherical shape.

In the present invention, examples of polymerizable monomers used in the polymerizable monomer composition include styrene-based monomers such as styrene, o-methylstyrene, m-methylstyrene, p-methylstyrene, p-methoxystyrene or p-ethylstyrene, acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate or phenyl acrylate, methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate or diethylaminoethyl methacrylate, acrylonitrile, methacrylonitrile and acrylamide.

These monomers can be used alone or as a mixture thereof. Among the above-mentioned monomers, styrene used alone or after mixing with other monomers is preferable from the viewpoint of developing performance and durability of the toner.

The polymerization initiator preferably has a half-life during the polymerization reaction of 0.5 hours to 30 hours. In addition, if the polymerization reaction is carried out using an added amount of polymerization initiator of 0.5 parts by mass to 20 parts by mass based on 100 parts by mass of polymerizable monomer, a polymer can be obtained having a maximum molecular weight of between 5000 and 50,000, thereby making it possible to impart a desirable level of strength and suitable dissolution properties to the toner.

Specific examples of polymerization initiators include azo-based and diazo-based polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile or azobisisobutyronitrile, and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy-2-ethyl hexanoate or t-butylperoxypivalate.

A crosslinking agent may be added when producing colored particles by suspension polymerization. The preferable added amount thereof is 0.1 parts by mass to 10.0 parts by mass based on 100 parts by mass of polymerizable monomer.

Here, a compound having two or more polymerizable double bonds is mainly used for the crosslinking agent, and examples thereof include aromatic divinyl compounds such as divinylbenzene or divinylnaphthalene, carboxylic acid esters having two double bonds such as ethylene glycol diacrylate, ethylene glycol dimethacrylate or 1,3-butanediol dimethacrylate, divinyl compounds such as divinyl aniline, divinyl ether, divinyl sulfide or divinyl sulfone, and compounds having three or more vinyl groups, and these compounds can be used alone or two or more types can be used as a mixture thereof.

In suspension polymerization, the polymerizable monomer composition, which is typically obtained by suitably adding the above-mentioned toner materials and the like followed by uniformly dissolving or dispersing with a disperser such as a homogenizer, ball mill or ultrasonic disperser, is suspended in an aqueous medium containing a dispersing agent. At this time, if a desired toner particle size is achieved all at once using a high-speed disperser in the manner of a high-speed stirrer or ultrasonic disperser, the resulting toner particles have a sharp particle size distribution. The timing of the addition of the polymerization initiator is such that the polymerization initiator may be added simultaneous to the addition of other additives present in the polymerizable monomer or may be mixed with polymerizable monomer immediately prior to suspending in the aqueous medium. In addition, a polymerization initiator dissolved in the polymerizable monomer or solvent can also be added immediately after granulation and prior to the start of the polymerization reaction.

Following granulation, stirring is carried out using an ordinary stirrer to a degree that the state of the particles is maintained and the separation or settling of particles is prevented.

A known surfactant, organic dispersing agent or poorly water-soluble inorganic dispersing agent can be used for the dispersing agent. Among these, since poorly water-soluble inorganic dispersing agents are unlikely to form harmful ultrafine powder and allow the obtaining of dispersion stability due to their steric hindrance, they are resistant to losing their stability even if there is a change in the reaction temperature while also facilitating washing and being unlikely to have a detrimental effect on the toner, thereby enabling them to be used preferably. Moreover, poorly water-soluble dispersing agents are also extremely preferable since they have high polarity, thereby facilitating inhibition of the precipitation of hydrophobic crystalline materials on the surface of toner particles.

Moreover, when carrying out the above-mentioned treatment step, in the case inorganic dispersing agent adheres to the colored particles, coalescence of colored particles can be inhibited significantly, thereby also making these dispersing agents extremely preferable.

Examples of such inorganic dispersing agents include polyvalent metal phosphates such as tricalcium phosphate, magnesium phosphate, aluminum phosphate, zinc phosphate or hydroxyapatite, carbonates such as calcium carbonate or magnesium carbonate, inorganic salts such as calcium metasilicate, calcium sulfate or barium sulfate, and inorganic compounds such as calcium hydroxide, magnesium hydroxide or aluminum hydroxide.

These inorganic dispersing agents are preferably used at 0.2 parts by mass to 20 parts by mass based on 100 parts by mass of polymerizable monomer.

In the case of using these inorganic dispersing agents, although they may be used as is, they can also be used by forming particles of the organic dispersing agent in an aqueous medium in order to obtain finer particles. For example, in the case of tricalcium phosphate, water-insoluble calcium phosphate can be formed by mixing aqueous sodium phosphate solution and aqueous calcium chloride solution while stirring rapidly, thereby enabling a more uniform, finer dispersion. At this time, although water-soluble sodium chloride is simultaneously formed as a by-product, when a water-soluble salt is present in an aqueous medium, dissolution of the polymerizable monomer in water is inhibited, which is preferable since it becomes difficult to form ultrafine toner particles by emulsion polymerization.

Examples of surfactants include sodium dodecylbenzene sulfate, sodium tetradecyl sulfate, sodium pentadecyl sulfate, sodium octyl sulfate, sodium oleate, sodium laurate, sodium stearate and potassium stearate.

The polymerization temperature in the step of polymerizing the above-mentioned polymerizable monomer is preferably set to at least 40° C. and more preferably at least 50° C. and not more than 100° C.

The following provides a description of the specific treatment step in the present invention.

Any known device may be used for the device used in the present invention that separates aqueous medium and colored particles by centrifugal force. Specific examples of separation devices preferably include basket-type centrifugal separators, disk-type centrifugal separators and decanter-type centrifugal separators. Among these, a decanter-type centrifugal separator is more preferable from the viewpoint of allowing colored particles to roll inside the device as previously described.

The basic structure of a decanter-type centrifugal separator is shown in FIG. 1. The decanter-type centrifugal separator shown in the drawing includes an external rotary cylinder and a screw conveyor provided within the external rotary cylinder so as to be able to rotate relatively with the external rotary cylinder. In the decanter-type centrifugal separator shown in the drawing, a slurry prior to separation treatment is supplied to an external rotary cylinder 2 through a tube 3 provided within a screw conveyor 1. When the rotary cylinder is rotated at high speed and high centrifugal force is applied to the slurry, colored particles present in the slurry settle and separate on the inner walls of the external rotary cylinder 2. The colored particles that have settled and separated are scraped together by blades 4 of the screw conveyor 1, which rotates along the same axis as the external rotary cylinder but has a slight rotational difference therewith, and gradually proceed in the direction of a discharge outlet 5 while rolling over the inner walls of the external rotary cylinder, after which the colored particles are discharged from the discharge outlet 5. On the other hand, the separated liquid (aqueous medium) that has been separated from the colored particles is discharged after overflowing from a separated liquid discharge outlet 6. At this time, since undesirable microparticles on which centrifugal force is difficult to act are also discharged from the separated liquid discharge outlet, toner performance can be expected to improve.

The centrifugal force applied to the above-mentioned decanter-type centrifugal separator is at least 500 G and less than 4000 G as was previously described. This can be adjusted to a desired centrifugal force by changing the rotating speed of the external rotary cylinder. The relationship represented in following formula (1) exists between the rotating speed of the external rotary cylinder and centrifugal force:

$$RCF=11.18(N/1000)^2R \quad (1)$$

(wherein, in formula (1), RCF represents centrifugal force (G), N represents rotating speed in revolutions per minute (rpm), and R represents the radius of the external rotary cylinder (cm)).

In addition, one example of a method for adjusting the ratio B following separation consists of adjusting the difference in rotating speeds (to be referred to as the differential rotating speed) between the external rotary cylinder and screw conveyor. A smaller differential rotating speed causes the slurry to remain longer in the device resulting in an increase in the ratio B. Conversely, a larger differential rotating speed shortens the amount of time the slurry spends in the device, thereby resulting in a decrease in the ratio B. In the present invention, the differential rotating speed is preferably at least 10 rpm and not more than 40 rpm and more preferably at least 20 rpm and not more than 40 rpm. The ratio B can also be adjusted by changing the diameter of an impeller 7 that determines the liquid layer of the separated liquid that is separated from the colored particles. For example, the ratio B is easily lowered by increasing the diameter of the impeller 7. The specific preferable range of the diameter of the impeller 7 is preferably adjusted while considering the radius of the external rotary cylinder and the difference in specific gravity between the colored particles and the separated liquid. In the present invention, the diameter of the impeller 7 is preferably adjusted so that the height of the separated liquid discharge outlet is higher than the discharge outlet.

The toner particle is obtained by washing, filtering and drying the colored particles using known methods after they have gone through the above-mentioned steps. Toner can be obtained by mixing an inorganic fine powder to be subsequently described with this toner particle and causing it to adhere to the surface of the toner particle as necessary. In addition, coarse powder and fine powder contained in the toner particle can also be removed by incorporating a classification step in the production process (prior to mixing the inorganic fine powder).

An additive such as a fluidizing agent may be mixed into the toner particle as necessary. A known technique can be used for the mixing method, and a Henschel mixer, for example, is a device that can be used preferably.

The fluidizing agent is preferably an inorganic fine powder having a primary particle number-average particle diameter of preferably 4 nm to 80 nm and more preferably 6 nm to 40 nm. Although the inorganic fine powder is added in order to improve flowability of the toner and ensure a uniform toner charge, imparting a function such as adjusting the charge quantity of the toner or improving environmental stability by subjecting the inorganic fine powder to treatment such as hydrophobic treatment is also a preferable aspect thereof. The primary particle number-average particle diameter of the inorganic fine powder is measured using a micrograph of an enlarged image of the toner obtained with a scanning electron microscope.

Examples of inorganic fine powder that can be used include silica, titanium oxide and alumina. Both dry silica, referred to as the so-called dry method or fumed silica formed by vapor-phase oxidation of a silicon halide, and so-called wet silica, produced from water glass or the like, can be used as silica fine powder. However, dry silica is preferable since there are few silanol groups on the surface or inside the silica fine powder and there is little production residue in the form of $Na_2O$ or $SO_3^{2-}$. In addition, the use of dry silica allows the obtaining of composite fine powder made of silica and other metal oxides in the production process by using, for example, other metal halides such as aluminum chloride or titanium chloride with a silicon halide.

The added amount of inorganic fine powder is preferably at least 0.1 parts by mass and not more than 3.0 parts by mass based on 100 parts by mass of the toner particle. Adequate effects of the addition thereof are obtained if the added amount is at least 0.1 parts by mass. In addition, fixing performance is favorable if the added amount is not more than 3.0 parts by mass. The content of the inorganic fine powder can be quantified using fluorescent X-ray analysis based on a calibration curve prepared from standard samples.

The inorganic fine powder is preferably subjected to hydrophobic treatment from the viewpoints of improving environmental stability of the toner. If inorganic fine powder added to toner absorbs moisture, the charge quantity of the toner particles decreases considerably, charge quantity easily becomes non-uniform and thereby toner scattering occurs easily. Examples of treatment agents used for hydrophobic treatment of inorganic fine powder include silicone varnish, various types of modified silicone varnish, silicone oil, various types of modified silicone oils, silane compounds, silane coupling agents, other organic silicon compounds and organic titanium compounds, of which one type may be used alone or two or more types may be used in combination.

Figure 2:
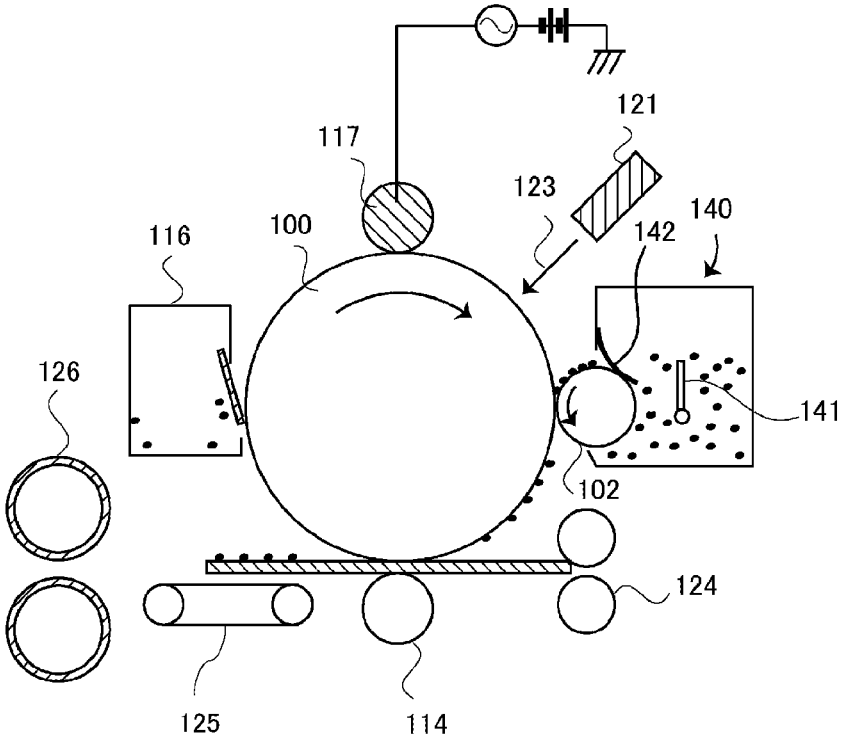
FIG. 2 is a drawing showing one example of an image forming apparatus.

The following provides a specific explanation of an example of an image forming apparatus capable of preferably using the toner according to the present invention with reference to FIG. 2. In FIG. 2, reference symbol 100 indicates a photosensitive member, and a developing device 140, having a charging roller 117, a developer carrying member 102, a stirring member 141 and a toner control member 142, a transfer charging roller 114, a cleaner 116, and a register roller 124 are provided around the periphery thereof. The photosensitive member 100 is charged to, for example, −600 V by the charging roller 117 (and the applied voltage is, for example, an alternating current voltage of 1.85 kVpp or direct current voltage of −620 Vdc). The photosensitive member 100 is then exposed by irradiating with a laser 123 using a laser generator 121, and an electrostatic latent image is formed corresponding to a target image. The electrostatic latent image on the photosensitive member 100 is developed with a single-component toner by the developing device 140 to obtain a toner image. The toner image is transferred onto a transfer material by the transfer roller 114 that has been contacted by the photosensitive member through the transfer material. The transfer material having the toner image transferred thereto is transported to a fixing unit 126 by a conveyor belt 125 or the like and the toner image is fixed on the transfer material. In addition, a portion of the toner remaining on the photosensitive member is cleaned therefrom by the cleaner 116.

Furthermore, although the example used here indicates an image forming apparatus that uses magnetic single-component jumping development, the image forming apparatus may use either jumping development or contact development.

Next, a description is provided of methods used to measure various properties.

<Measurement of Toner Particle Weight-Average Particle Diameter (D4)>

The weight-average particle diameter (D4) of a toner particle is calculated as follows. Namely, a precision particle size distribution analyzer operating according to the pore electrical resistance method and provided with a 100 μm aperture tube ("Coulter Counter Multisizer 3®", Beckman Coulter, Inc.) is used for the measuring apparatus. Dedicated software provided with the analyzer ("Beckman Coulter Multisizer 3 Version 3.51", Beckman Coulter, Inc.) is used to set measurement conditions and analyze measurement data. Furthermore, measurements are carried out using an effective number of measurement channels of 25,000.

The electrolytic solution used in measurement was prepared by dissolving special grade sodium chloride in ion exchange water to a concentration of about 1% by mass, and "ISOTON II" (Beckman Coulter, Inc.), for example, can be used.

Furthermore, settings of the dedicated software are made as indicated below prior to carrying out measurement and analysis.

The total number of counts of the control mode is set to 5.0 particles, the number of measurements is set to one, and the resulting values are set using Kd value (10.0 μm standard particle, Beckman Coulter, Inc.) on the "Change Standard Operating Method (SOM) Screen". The threshold and noise levels are set automatically by pressing the "Threshold/Noise Level Measurement Button". In addition, current is set to 1600 μA, gain to 2 and electrolytic solution to ISOTON II, followed by checking "Flush Aperture Tube after Measurement".

The bin interval is set to logarithmic particle diameter, particle diameter bin is set to the 256 particle diameter bin, and particle diameter range is set to 2 μm to 60 μm.

The following provides a detailed description of the measurement method.

(1) About 200 mL of the above-mentioned electrolytic solution are placed in the 250 mL glass round-bottom beaker for use exclusively with the Multisizer 3, the flask is placed on a sample stand, and stirring with a stirrer rod is carried out at 24 revolutions/second in the counter-clockwise direction. The inside of the aperture tube is cleaned and air bubbles are removed using the "Aperture Flush" function of the dedicated software.

(2) About 30 mL of the above-mentioned electrolytic solution are placed in a 100 mL glass flat-bottom beaker. About 0.3 mL of a diluted solution, prepared by diluting a dispersing agent in the form of "Contaminon N" (10% by mass aqueous solution of pH 7 neutral detergent for cleaning precision measuring apparatuses composed of nonionic surfactant, anionic surfactant and organic builder, Wako Pure Chemical Industries, Ltd.) about 3 times by mass with ion exchange water, are then added to the electrolytic solution.

(3) An ultrasonic disperser ("Ultrasonic Dispersion System Tetora 150", Nikkaki Bios Co., Ltd.) having an electric output of 120 W and equipped with two built-in oscillators having an oscillating frequency of 50 kHz and shifted in phase by 1800 is prepared. About 3.3 L of ion exchange water are placed in the water tank of the ultrasonic disperser followed by adding about 2 mL of Contaminon N to the water tank.

(4) The beaker described in (2) above is placed in the beaker mounting hole of the above-mentioned ultrasonic disperser followed by operating the ultrasonic disperser. The height of the beaker is then adjusted so that the resonating state of the surface of the electrolytic solution inside the beaker reaches a maximum.

(5) About 10 mg of the toner particle are added a little at a time to the above-mentioned electrolytic solution and dispersed therein while applying ultrasonic waves to the electrolytic solution inside the beaker described in (4) above. This ultrasonic dispersion treatment is continued for an additional 60 seconds. Furthermore, the temperature of the water inside the water tank is suitably adjusted to at least 10° C. and not more than 40° C. during ultrasonic dispersion.

(6) The electrolytic solution of (5) above having toner dispersed therein is dropped into the round-bottom beaker placed on the sample stand as described in (1) above using a pipette and the measured concentration is adjusted to about 5%. Measurement is carried out until the number of measured particles reaches 50,000.

(7) Measurement data is then analyzed with the above-mentioned dedicated software provided with the apparatus followed by calculation of weight-average particle diameter (D4). Furthermore, "average diameter", which is displayed on the "Analysis/Volume Statistics (Arithmetic Average)" screen when the apparatus has been set to Graph/Volume % with the dedicated software, indicates the weight-average particle diameter (D4).

<Measurement of Glass Transition Temperature (Tg) of Colored Particle and Other Resin>

Glass transition temperature (Tg) is measured in compliance with ASTM D3418-82 using a differential scanning calorimeter ("Q1000", TA Instruments). The melting points of indium and zinc are used to correct the temperature of the detection unit of the calorimeter, while the heat of fusion of indium is used to correct calorific value. More specifically, about 10 mg of sample such as colored particles are precisely weighed and placed in an aluminum pan followed by using an empty aluminum pan as a reference and measuring over a measuring range of 30° C. to 200° C. at a ramp rate of 10° C./minute. A change in specific heat is obtained over a range of 40° C. to 100° C. during the course of raising the temperature. The intersection of a line at the midpoint of the baselines before and after the appearance of the change in specific heat at this time with the differential thermal curve is the glass transition temperature.

EXAMPLES

Although the following provides a more detailed explanation of the present invention through production examples and examples thereof, the present invention is not limited in any way thereto. Furthermore, numbers of parts indicated in the following preparations all indicate parts by mass.

<Production Example of Polyester Resin>

The following components were placed in a reaction tank equipped with a condenser tube, stirrer and nitrogen feed tube and allowed to react for 10 hours in the presence of flowing nitrogen at 230° C. while distilling off water formed.

Bisphenol A ethylene oxide (EO) 2 mole adduct 350 parts by mass

Bisphenol A propylene oxide (PO) 2 mole adduct 326 parts by mass

Terephthalic acid 250 parts by mass

Titanium-based catalyst (titanium dihydroxybis(triethanol aminate)) 2 parts by mass Next, the above-mentioned components were allowed to react under reduced pressure at 5 mmHg to 20 mmHg and cooled to 180° C. at the point the acid value reached 0.1 mg KOH/g, followed by adding 15 parts by mass of trimellitic anhydride, removing from the reaction tank after reacting for 2 hours while sealed at normal pressure, and cooling to room temperature and then pulverizing to obtain polyester resin. The acid value of the resulting resin was 1.0 mg KOH/g or lower.

<Production Example of Magnetic Powder 1>

Sodium hydroxide solution equal to 1.00 to 1.10 equivalents of elemental iron, an amount of $P_2O_5$ as elemental phosphorous equal to 0.15% by mass based on elemental iron, and an amount of $SiO_2$ as elemental silicon equal to 0.50% by mass based on elemental iron were mixed in an aqueous ferrous sulfate solution to prepare an aqueous solution containing ferrous hydroxide. The pH of the aqueous solution was adjusted to 8.0 and an oxidation reaction was carried out at 85° C. while blowing in air to prepare a slurry having seed crystals. Next, after adding aqueous ferrous sulfate solution to this slurry in an amount equal to 0.90 to 1.20 equivalents of the initial amount of base (sodium component of the sodium hydroxide), the pH of the slurry was adjusted to 7.6 and the oxidation reaction was allowed to proceed while blowing in air to obtain a slurry containing magnetic iron oxide. After filtering and washing, the water-containing slurry was temporarily removed. At this time, a small sample of the water-containing slurry was collected followed by measuring the water content thereof. Next, this water-containing slurry was placed in a different aqueous medium without drying and re-dispersed with a pin mill while stirring and circulating the slurry followed by adjusting the pH of the re-dispersed solution to about 4.8. 1.6 parts of n-hexyltrimethoxysilane coupling agent were added to 100 parts of the magnetic iron oxide while stirring (the amount of magnetic iron oxide was calculated as the value obtained by subtracting the water content of the water-containing sample) followed by carrying out hydrolysis. Subsequently, the mixture was stirred well followed by carrying out surface treatment after adjusting the pH of the dispersed solution to 8.6. The hydrophobic magnetic powder that formed was filtered with a filter press and after washing with a large amount of water, the powder was dried for 15 minutes at 100° C. and then for 30 minutes at 90° C. followed by deagglomerating the resulting particles to obtain Magnetic Powder 1 having a volume-average particle diameter of 0.21 μm.

<Wax Properties>

The properties of Waxes 1 to 4 used in the examples and comparative examples are indicated in Table 1.

TABLE 1

| Crystalline Substance | Name | Ester Group Content | Melting Point Tm (° C.) |
|---|---|---|---|
| Wax 1 | Dibehenyl sebacate | 2 | 73 |
| Wax 2 | Behenyl behenate | 1 | 72 |
| Wax 3 | Dipentaerythritol hexabehenate | 6 | 76 |
| Wax 4 | Fischer-Tropsch wax | 0 | 78 |

<Production of Crystalline Polyester 1>

100 parts by mass of sebacic acid as carboxylic acid monomer and 60 parts by mass of 1,16-hexadecanediol as alcohol monomer were charged into a reaction tank equipped with a nitrogen feed tube, dehydration tube, stirrer and thermocouple. The temperature was raised to 140° C. while stirring followed by heating to 140° C. in a nitrogen atmosphere and allowed to react for 8 hours while distilling off water under normal pressure. Next, 1 part by mass of tin dioctylate was added to 100 parts by mass of the total amount of monomer followed by reacting while raising the temperature to 200° C. at a ramp rate of 10° C./hour. Moreover, after allowing to react for 2 hours after reaching 200° C., the inside of the reaction tank was depressurized to 5 kPa or less followed by allowing to react for 3 hours at 200° C. to obtain Crystalline Polyester 1. The weight-average molecular weight (Mw) of the resulting Crystalline Polyester 1 was 44,500 and the acid value was 1.2 mg KOH/g.

<Production of Crystalline Polyester 2 and 3>

Crystalline Polyester 2 and 3 were obtained in the same manner as in the production of Crystalline Polyester 1 with the exception of using the carboxylic acid monomers and alcohol monomers shown in Table 2. Crystalline Polyesters 1 to 3 had sharp endothermic peaks as determined by differential scanning calorimetry (DSC).

TABLE 2

| | Alcohol Monomer | Charged Amount (parts by mass) | Carboxylic Acid Monomer | Charged Amount (parts by mass) | Mw | Acid Value |
|---|---|---|---|---|---|---|
| Crystalline Polyester 1 | 1,16-hexadecanediol | 60.0 | Decanedioic acid (sebacic acid) | 100.0 | 44500 | 1.2 |
| Crystalline Polyester 2 | 1,9-nonanediol | 90.0 | Decanedioic acid (sebacic acid) | 100.0 | 38000 | 2 |
| Crystalline Polyester 3 | 1,12-dodecanediol | 110.0 | Decanedioic acid (sebacic aoid) | 100.0 | 35000 | 1.7 |

<Production Example of Silica Fine Particles>

Untreated dry silica (primary particle number-average particle diameter: 9 nm) was charged into an autoclave equipped with a stirrer followed by heating to 200° C. in a fluidized state achieved by stirring.

After replacing the inside atmosphere of the reactor with nitrogen gas and sealing, 25 parts by mass of hexamethyldisilazane were sprayed onto 100 parts by mass of the untreated silica the reactor to carry out silane compound treatment with the silica in a fluidized state. The reaction was terminated after continuing for 60 minutes. Following completion of the reaction, the pressure inside the autoclave was released followed by washing with flowing nitrogen gas to remove excess hexamethyldisilazane and by-products from the hydrophobic silica.

Moreover, 20 parts by mass of dimethyl silicone oil (viscosity: 100 $mm^2/s$) were sprayed onto 100 parts by mass of the untreated silica while stirring the inside of the reaction tank, and after continuing to stir for 30 minutes, the temperature was raised to 300° C. while stirring followed by removing the silica after stirring for 3 hours and subjecting the silica to deagglomeration treatment to obtain Silica Fine Particle C. Properties of the Silica Fine Particle C are a primary particle number-average particle diameter of 9 nm, BET specific surface area of 130 $m^2/g$ and apparent density of 30 g/L.

Toner particles and toner were produced according to the procedure indicated below.

<Production Example of Toner 1>

(Preparation of Aqueous Medium)

3.1 parts by mass of sodium phosphate 12 hydrade were charged into 342.8 parts by mass of ion exchange water and then heated to 60° C. while stirring using a T.K. Homomixer (Tokushu Kika Kogyo Co., Ltd.) followed by adding an aqueous calcium chloride solution obtained by adding 1.8 parts by mass of calcium chloride dihydrate to 12.7 parts by mass of ion exchange water and continuing to stir to obtain an aqueous medium containing a dispersion stabilizer.

(Preparation of Polymerizable Monomer Composition)

| | |
|---|---|
| Styrene | 77.0 parts by mass |
| n-Butyl acrylate | 23.0 parts by mass |
| 1,6-hexanediol diacrylate | 0.55 parts by mass |
| Aluminum salicylate compound (E-101: Orient Chemical Industries Co., Ltd.) | 0.3 parts by mass |
| Colorant: Magnetic Powder 1 | 65.0 parts by mass |
| Polyester resin | 20.0 parts by mass |

After uniformly dispersing and mixing the above-mentioned materials using an attritor (Mitsui Miike Chemical Engineering Machinery, Co., Ltd.), the mixture was heated to 60° C. followed by the addition of 10.0 parts by mass of Wax 1 as a crystalline material thereto and mixing followed by dissolving therein to obtain a polymerizable monomer composition.

(Granulation)

The above-mentioned copolymerizable monomer composition and 9.0 parts by mass of t-butylperoxypivalate a polymerization initiator were charged into the above-mentioned aqueous medium followed by granulating while stirring for 10 minutes at 12,000 rpm with a T.K. Homomixer (Tokushu Kika Kogyo Co., Ltd.) at 60° C. and in an $N_2$ atmosphere to obtain a granulation liquid containing droplets of polymerizable monomer composition.

(Polymerization, Distillation and Drying)

The above-mentioned granulation liquid was allowed to react for 4 hours at 74° C. while stirring with a paddle stirring blade. Following completion of the reaction, the liquid was distilled for 5 hours at 98° C. Colored particles were dispersed in the resulting aqueous medium, and calcium phosphate was confirmed to be adhered to the surfaces of the colored particles as an inorganic dispersing agent. At this point, hydrochloric acid was added to the aqueous medium to wash off and remove calcium phosphate followed by filtering, drying and analysis of the colored particles. As a result, the glass transition temperature Tg of the colored particles was 56° C. Subsequently, the aqueous medium having the colored particles dispersed therein was cooled to a treatment temperature (Ts) of 50° C. at the rate of 5° C./minute. Then the ratio of colored particles was measured and determined to be 10% by mass (ratio A). The above-mentioned slurry was charged into a screw decanter-type centrifugal separator adjusted to centrifugal force of 3000 G and differential rotating speed of 20 rpm (Model HS-L: IHI Corporation) to obtain a condensed slurry. The ratio of the colored particles in the condensed slurry was 20% by mass (ratio B).

Subsequently, hydrochloric acid was added to wash the slurry followed by filtering and drying to obtain Toner Particle 1 having a weight-average particle diameter of 8.0 μm.

0.8 parts by mass of Silica Fine Powder C were mixed with 100 parts by mass of the resulting toner particles with an FM Mixer (Nippon Coke & Engineering Co., Ltd.) to obtain Toner 1. The particle size distribution (D50/D1) of the resulting toner was 1.12 and circularity was 0.979.

<Production Examples of Toners 2 to 10 and Comparative Toners 1 to 15>

Toners 2 to 10 and Comparative Toners 1 to 15 were obtained in the same manner as in the production example of Toner Particle 1 with the exception of changing the type of crystalline material, type of centrifugal separator, centrifugal force of the centrifugal separator, differential rotating speed, treatment temperature (Ts) and ratios of colored particles in slurries as shown in Table 3.

Furthermore, "disk type" indicated for the type of separation device in Table 3 indicates that a disk-type centrifugal separator (Westfalia Separator Japan K.K.) was used.

In addition, "Filter press" indicated for the type of separation device in Table 3 indicates that a commercially available filter press (Model ISD Lasta Filter, Ishigaki Company, Ltd.) was used, while "Synchro filter" indicated for the type of separation device indicates that a commercially available synchro filter (Tsukishima Kikai Co., Ltd.) was used.

TABLE 3

| Toner No. | Type of Crystalline Material | Centrifugal Force (G) | Differential Rotating Speed | Colored Particle Tg (° C.) | Treatment temperature Ts (° C.) | Type of Separation Device | Ratio A (% by mass) | Ratio B (% by mass) |
|---|---|---|---|---|---|---|---|---|
| Toner 1 | Wax 1 | 3000 | 20 | 56 | 50 | Decanter type | 10 | 20 |
| Toner 2 | Wax 1 | 2500 | 30 | 56 | 50 | Decanter type | 10 | 15 |
| Toner 3 | Wax 1 | 3900 | 20 | 56 | 50 | Decanter type | 20 | 40 |
| Toner 4 | Wax 2 | 3000 | 20 | 56 | 50 | Decanter type | 20 | 40 |
| Toner 5 | Wax 3 | 3000 | 20 | 58 | 51 | Decanter type | 20 | 40 |
| Toner 6 | Crystalline Polyester 1 | 3000 | 20 | 58 | 51 | Decanter type | 20 | 40 |
| Toner 7 | Crystalline Polyester 2 | 3000 | 20 | 59 | 52 | Decanter type | 20 | 40 |
| Toner 8 | Crystalline Polyester 3 | 3000 | 20 | 59 | 52 | Decanter type | 20 | 40 |
| Toner 9 | Wax 4 | 3000 | 20 | 56 | 50 | Decanter type | 10 | 20 |
| Comparative Toner 7 | Wax 4 | 3000 | 5 | 56 | 50 | Decanter type | 10 | 70 |
| Toner 10 | Wax 4 | 3000 | 20 | 56 | 50 | Decanter type | 50 | 60 |
| Comparative Toner 8 | Wax 4 | 3000 | 10 | 56 | 50 | Decanter type | 50 | 80 |
| Comparative Toner 9 | Wax 4 | 3000 | — | 56 | 50 | Disk type | 50 | 80 |
| Comparative Toner 10 | Wax 4 | 3000 | — | 56 | 47 | Disk type | 50 | 80 |
| Comparative Toner 11 | Wax 4 | 3000 | — | 56 | 65 | Disk type | 50 | 80 |
| Comparative Toner 12 | Wax 4 | 1000 | — | 56 | 50 | Disk type | 50 | 80 |
| Comparative Toner 13 | Wax 4 | 500 | — | 56 | 50 | Disk type | 50 | 80 |
| Comparative Toner 14 | Wax 4 | 500 | — | 56 | 47 | Disk type | 50 | 80 |
| Comparative Toner 15 | Wax 4 | 500 | — | 56 | 65 | Disk type | 50 | 80 |
| Comparative Toner 1 | Wax 1 | 300 | 20 | 56 | 50 | Decanter type | 10 | 20 |
| Comparative Toner 2 | Wax 1 | 3000 | 20 | 56 | 27 | Decanter type | 10 | 20 |
| Comparative Toner 3 | Wax 1 | 3000 | 20 | 56 | 40 | Decanter type | 10 | 20 |
| Comparative Toner 4 | Wax 1 | 3000 | 20 | 56 | 70 | Decanter type | 10 | 20 |
| Comparative Toner 5 | Wax 1 | — | — | 56 | 50 | Filter press | 10 | 80 |
| Comparative Toner 6 | Wax 1 | — | — | 56 | 50 | Synchro filter | 10 | 80 |

Example 1

The following evaluations were carried out on the above-mentioned Toner 1. Evaluation results are shown in Table 4.

(Image Forming Apparatus)

Image output test performed using modified a Canon Inc. Model LBP3100 printer. Modifications consisted of changing the process speed from the original speed to a faster speed of 250 mm/sec, and allowing the developing sleeve to contact the electrostatic latent image bearing member as shown in FIG. 2. Furthermore, contact pressure was adjusted so that the contact region between the developing sleeve and electrostatic latent image bearing member was 1.0 mm. As a result of making these modifications, drum fogging can be evaluated more rigorously in the absence of a toner supply member.

This modified printer was filled with 200 g of Toner 1 and used to carry out a 2000 image output test by printing out horizontal lines having a print percentage of 1% in the 2-print intermittent mode in a low-temperature, low-humidity environment (temperature: 15° C., relative humidity: 10% RH).

As a result of carrying out the image output test in a low-temperature, low-humidity environment (temperature: 15° C., relative humidity: 10% RH), the toner can be charged up easily and fogging can be evaluated rigorously.

<Drum Fogging>

Fogging was measured using the Model TC-6DS Reflectometer manufactured by Tokyo Denshoku Co., Ltd. A green filter was used for the filter.

In order to calculate fogging on the electrostatic latent image bearing member, a Mylar tape sampling toner on the electrostatic latent image bearing member immediately after outputting a solid black image and before transferring a solid white image was prepared. Fogging on the electrostatic latent image bearing member was calculated by subtracting reflectance (%) of the Mylar tape sampling toner attached on an unused paper from the reflectance (%) of an unused Mylar tape attached on unused paper.

A: Not more than 5%

B: At least 6% and not more than 10%

C: At least 11% and not more than 20%

D: At least 21%

<Evaluation of Image Density>

Following completion of printout in the above-mentioned low-temperature, low-humidity environment, image density was evaluated in the same environment. Image density was evaluated by forming a solid black image area and then measuring the image density of this solid black image with a Macbeth reflection densitometer (GretagMacbeth GmbH). Evaluation criteria used to evaluate reflection density of the solid black images were as indicated below.

A: At least 1.46

B: At least 1.41 and not more than 1.45

C: At least 1.36 and not more than 1.40

D: Not more than 1.35

<Evaluation of Post-Durability Development Streaks>

Development streaks were evaluated in the same environment following completion of printing out images in the above-mentioned low-temperature, low-humidity environment.

Development streaks were evaluated by removing through air-bowing the toner present on the developing sleeve following durable use, comparing the results of visually confirming the fused state of the developing sleeve with the results of visually confirming image quality following the output of halftone images, and evaluating according to the criteria indicated below.

A: No streaks on the developing sleeve and no streaks on the resulting image

B: Minor streaks present on the developing sleeve but not present on the resulting image C: Large number of minor streaks present on the developing sleeve but none present on the resulting image D: Prominent streaks present on the developing sleeve or streaks present on the resulting image Examples 2 to 10 and Comparative Examples 1 to 15

Toner was evaluated under the same conditions as Example 1 using Toners 2 to 10 and Comparative Toners 1 to 15 for the toner. Evaluation results are shown in Table 4.

TABLE 4

| | | Image Density | Fogging | Development Streaks |
|---|---|---|---|---|
| Example 1 | Toner 1 | A(1.47) | A(3%) | A |
| Example 2 | Toner 2 | A(1.46) | A(3%) | A |
| Example 3 | Toner 3 | A(1.47) | A(4%) | A |
| Example 4 | Toner 4 | A(1.47) | A(3%) | A |
| Example 5 | Toner 5 | A(1.48) | A(4%) | A |
| Example 6 | Toner 6 | A(1.47) | A(4%) | A |
| Example 7 | Toner 7 | A(1.46) | A(4%) | A |
| Example 8 | Toner 8 | A(1.46) | A(4%) | A |
| Example 9 | Toner 9 | A(1.47) | B(6%) | A |
| Comparative Example 7 | Comparative Toner 7 | A(1.46) | B(7%) | B |
| Example 10 | Toner 10 | A(1.46) | B(6%) | B |
| Comparative Example 8 | Comparative Toner 8 | A(1.47) | B(8%) | B |
| Comparative Example 9 | Comparative Toner 9 | B(1.43) | B(8%) | B |
| Comparative Example 10 | Comparative Toner 10 | B(1.42) | B(9%) | B |
| Comparative Example 11 | Comparative Toner 11 | B(1.45) | B(10%) | B |
| Comparative Example 12 | Comparative Toner 12 | B(1.43) | B(9%) | B |
| Comparative Example 13 | Comparative Toner 13 | B(1.41) | C(12%) | B |
| Comparative Example 14 | Comparative Toner 14 | B(1.41) | C(16%) | C |
| Comparative Example 15 | Comparative Toner 15 | C(1.39) | C(17%) | C |
| Comparative Example 1 | Comparative Toner 1 | C(1.38) | D(22%) | C |
| Comparative Example 2 | Comparative Toner 2 | D(1.31) | D(25%) | D |
| Comparative Example 3 | Comparative Toner 3 | C(1.37) | D(28%) | C |
| Comparative Example 4 | Comparative Toner 4 | D(1.21) | D(34%) | D |
| Comparative Example 5 | Comparative Toner 5 | D(1.30) | D(38%) | D |
| Comparative Example 6 | Comparative Toner 6 | D(1.29) | D(35%) | D |

As has been explained above, according to the present invention, a toner can be provided that allows the obtaining of favorable image density while also allowing the obtaining of favorable stable images free of fogging or development streaks even under conditions of long-term, durable use under low-temperature, low-humidity conditions using a compact image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-060426, filed Mar. 24, 2016 which is hereby incorporated by reference herein in its entirety.

What is claimed is:

1. A method for producing a toner particle comprising a treatment step of treating a raw slurry containing an aqueous medium and colored particles each containing a binder resin and a colorant, wherein the treatment step includes a step of condensing the raw slurry by using a decanter-type centrifugal separator so as to obtain a condensed slurry, the decanter-type centrifugal separator includes an external rotary cylinder and a screw conveyor provided within the external rotary cylinder so as to be able to rotate relatively with the external rotary cylinder, and the step of condensing the raw slurry is carried out under conditions below:

i) a centrifugal force is at least 500 G and less than 4000 G; and ii) a temperature (Ts) is at least Tg−10° C. and not more than Tg+10° C. when the glass transition temperature of the colored particles is defined as Tg (° C.), and wherein when a ratio of the colored particles in the condensed slurry is defined as ratio B, the ratio B is at least 10% by mass and not more than 60% by mass.

2. The method for producing a toner particle according to claim 1, wherein when a ratio of the colored particle in the raw slurry is defined as ratio A, the ratio A is at least 5% by mass and not more than 40% by mass.

3. The method for producing a toner particle according to claim 1, wherein the colored particles contain ester wax or crystalline polyester.

4. The method for producing a toner particle according to claim 1, wherein the colorant contains magnetic powder.

* * * * *